US008393343B2

(12) United States Patent
VanVonderen

(10) Patent No.: US 8,393,343 B2
(45) Date of Patent: Mar. 12, 2013

(54) RAILING MOUNTED SHADE

(76) Inventor: Susan VanVonderen, St. Paul, MN (US)

( * ) Notice: Subject to any disclaimer, the term of this patent is extended or adjusted under 35 U.S.C. 154(b) by 0 days.

(21) Appl. No.: 13/374,064

(22) Filed: Dec. 9, 2011

(65) Prior Publication Data

US 2012/0145207 A1 Jun. 14, 2012

Related U.S. Application Data

(63) Continuation of application No. 29/372,589, filed on Dec. 13, 2010.

(51) Int. Cl.
*E04H 15/28* (2006.01)

(52) U.S. Cl. ..... 135/98; 135/16

(58) Field of Classification Search ..... 135/20.1, 135/98, 15.1, 16; 248/534, 539, 218.4, 219.3
See application file for complete search history.

(56) References Cited

U.S. PATENT DOCUMENTS 2,559,421 A * 7/1951 Garrett ..... 248/515
2,705,603 A * 4/1955 Bitz et al. ..... 248/541
4,086,931 A * 5/1978 Hall ..... 135/98
4,433,699 A * 2/1984 Schultes et al. ..... 135/15.1
4,836,231 A * 6/1989 Peterson ..... 135/98
4,836,232 A * 6/1989 De Rosa et al. ..... 135/99
5,287,872 A * 2/1994 Anderson ..... 135/98
5,857,658 A * 1/1999 Niemiec ..... 248/534
6,003,826 A * 12/1999 Galloway, III ..... 248/519
6,375,146 B1 * 4/2002 Painchaud ..... 248/534
6,422,252 B1 * 7/2002 Pilz et al. ..... 135/98
6,672,559 B1 * 1/2004 Boldia ..... 248/538
6,676,094 B1 * 1/2004 Brown ..... 248/214
6,708,703 B1 * 3/2004 Rivers et al. ..... 135/16
7,201,442 B1 * 4/2007 Decosta, Jr. ..... 297/184.16
7,229,060 B2 * 6/2007 Collins ..... 248/534

* cited by examiner

*Primary Examiner* — Noah Chandler Hawk
(74) *Attorney, Agent, or Firm* — DL Tschida

(57) ABSTRACT

A shade assembly adapted for use with deck and balcony settings. A shade cover piece is supported to a pole. The support pole includes a hub assembly for horizontally varying the diametric displacement of a number of stays and the shade cover and a hinge assembly for adjusting the angle of the shade cover relative to the support pole. Associated fasteners having channel and collar pieces adapted to rails, balusters and deck boards secure the support pole and shade cover to rails, balusters and/or deck boards of a deck, patio or balcony railing system. Split band collars compressively grip the support pole and rigidly anchor the support pole and cover piece to the railing. Alternative stay stops and non-marring fastener liners are also disclosed.

18 Claims, 12 Drawing Sheets

RAILING MOUNTED SHADE

RELATED APPLICATION DATA

This is a continuation application of pending design application U.S. Ser. No. 29/372,589 filed on Dec. 13, 2010.

BACKGROUND OF THE INVENTION

The present invention relates to patio and yard furnishings and, in particular, to a fan or umbrella shade assembly having a pole mounted, collapsible fabric shade piece and one or more coupler assemblies for securing the shade piece to a deck system (e.g. railing, floor and/or balusters).

Sun shade devices have been developed for a variety of applications and settings. Some shade devices comprise framed structures having roofs or tops that are permanently or semi-permanently mounted to a site. Other shade assemblies provide open and/or closed-sided tent or gazebo type structures that can be erected to cover appropriate lawn furniture. Still other shade devices provide rigid or expanding and contracting awning assemblies that mount to buildings, recreational vehicles and the like to shade windows and/or doorways against the sun or elements (e.g. rain and snow). Drive linkages fitted to fabric cover pieces extend and retract the awnings.

A variety of other types of sun shade devices comprise cover pieces that are deployed to predetermined open conditions. Other cover pieces comprise collapsible umbrella-like, fabric members that can be collapsed for storage or during windy conditions to prevent damage to the cover piece, such as tearing or ripping of the seams. The latter devices are frequently found in yard or garden settings in combination with picnic tables, café tables, patio tables or sundry types of weighted base pieces. These devices are relatively inexpensive and permit storage during inclement weather or seasons. The poles and/or cover pieces can be replaced as desired or necessary.

An associated pole support is typically supported to a relatively heavy weight table or base piece (e.g. cast metal or water or sand-filled ring) to stabilize the cover piece against wind movement. The pole frequently includes a crank arm and internal pulleys and ropes for controlling the exposure or radial displacement of the cover relative to the pole. Most typically the cover piece is supported to a number of radial stays that rise and fall as the crank arm is manipulated. The pole may also include means (e.g. a hinge) for varying the angle of the deployed cover piece relative to the pole piece. The exposure and/or placement of the cover piece relative to persons shielded by the cover can thus be periodically changed relative to sun movement and/or wind conditions to optimize the shade relative to the users and ambient conditions.

A problem with many of the latter devices and reason for the combination with relatively heavy weight base pieces is that the exposure of the shade cover piece to prevailing winds can cause the cover to collapse, tear apart or lift out of the base support. Detachment of the cover piece from the base support can also injure persons seated in the vicinity of the shade device.

The shortcomings of the foregoing collapsible shade assemblies to wind and updrafts particularly exist on bluff-side properties, elevated decks or balconies of multi-level dwellings. Prevailing winds and up draft conditions generally preclude the use of these assemblies by the foregoing home owners or apartment dwellers. The use of any available outdoor balcony or deck amenities during windy conditions thus typically requires that any shade cover piece be collapsed to restrict and/or limit the exposure to prevailing winds which in turn limits the amount of available shade.

The present invention was developed to provide a shade cover assembly that is particularly adapted to prevent detachment of the shade cover and support pole. The assembly is especially adapted for use with deck, patio and balcony settings. The assembly includes a shade cover piece constructed of an appropriate UV and weather resistant material. The shade cover piece is formed to a partial or full circular shape and is supported to a pole. The support pole can provide a mechanism for collapsing or extending the shade cover piece to a maximum open condition. The support pole can also include a hinging mechanism to permit adjusting the angle of the shade cover piece relative to the support pole.

Associated couplers or clamp pieces secure the support pole and shade cover piece to a railing system at the mounting site. Fasteners are particularly disclosed that retain the shade cover and support pole to the rails, deck boards or balusters of a railing system found at a typical deck, patio or balcony. The fastener mechanisms include channel pieces that capture rails, floor boards or balusters and associated collar couplers that contain the pole support. Upon mounting the channel pieces to the rails, balusters and/or deck boards and interlocking the support pole to one or more of the fasteners the support pole and shade cover piece are restrained to the railing system and/or deck. The support pole and shade cover piece are thereby securely restrained and anchored to the physical structure of the deck, patio or balcony, even if the shade cover piece is destroyed by wind.

SUMMARY OF THE INVENTION

It is accordingly a primary object of the invention to provide a sun shade assembly that mounts to a railing system and/or floor at a deck, patio, balcony or other outdoor site.

It is a further object of the invention to provide a shade cover piece that expands and contracts to deploy to a partial or full circular configuration relative to a support pole.

It is a further object of the invention to provide a shade cover piece that is supported to several radially directed stays and a mechanism for directing the angle of relative alignment of the stays to the support pole to deploy or collapse the shade cover piece.

It is a further object of the invention to provide a multi-section support pole having a mechanism for varying the relative angle between the pole sections to control the amount of shade provided relative to movement of the sun.

It is a further object of the invention to provide a support pole adapted to interlock and fasten to a bracket supported to a structural support of a railing system such as found at a deck, patio or balcony.

It is a further object of the invention to provide upper and lower fastener or coupler pieces that fasten to rail pieces or balusters of a railing system and include tubular pole support portions that fasten to secure the support pole and a shade cover piece to the railing system.

It is a further object of the invention to provide a support pole coupler piece that fastens to a deck floor and includes a tubular pole support portion for interlocking with a support pole and securing the pole and associated shade cover piece to a deck, patio or balcony floor.

It is a further object of the invention to provide a support pole coupler piece that fastens to a baluster of a railing system and includes a pole support portion for interlocking with a support pole and securing the pole and associated shade cover piece to a railing system baluster of a deck, patio or balcony.

The foregoing objects, advantages and distinctions of the invention are obtained in a presently preferred railing mounted shade assembly. A flexible shade cover piece is supported to a pole and the pole is rigidly fastened to a railing system and/or floor at an outdoor site (e.g. deck, patio or balcony). The support pole can include means for collapsing and controlling the deployment and exposure of the shade cover piece and/or means for controlling the relative angle of the shade cover piece to the support pole. A presently preferred hub assembly is disclosed having horizontally rotating stays that interconnect with the shade cover piece and rotate the shade cover piece between collapsed and expanded conditions. The hub assembly is hinged to the support pole and includes a coupler having arms that control the angle of the shade cover to the support pole.

Fastener assemblies adapted to mount to rails or balusters of a railing system interlock with the support pole. Presently preferred fasteners provide channel pieces that grip the railing system and include split bands or collars through which the support pole mounts and which fasten to compressively grip the pole and fix the fasteners to the railing/floor system. The displacement of the fastener channel pieces can be made fixed or adjustable to adapt to rails and balusters of differing dimensions, shapes and spacings. The channel pieces can also include liners to facilitate a conformal and/or non-marring mounting. Provisions are also made at some of the fastener assemblies to adjust the offset of a support pole gripping portion from the railing system.

An alternative fastener or coupler assembly is also disclosed that adjustably secures the support pole to a deck floor. Still another coupler assembly is disclosed that adjustably secures the support pole to a railing baluster.

Still other objects, advantages, distinctions and constructions of the invention will become more apparent from the following description with respect to the appended drawings. Similar components and assemblies are referred to in the various drawings with similar alphanumeric reference characters. The description should not be literally construed in limitation of the invention. Rather, the invention should be interpreted within the broad scope of the further appended claims.

DESCRIPTION OF THE PREFERRED EMBODIMENTS

Figure 1:
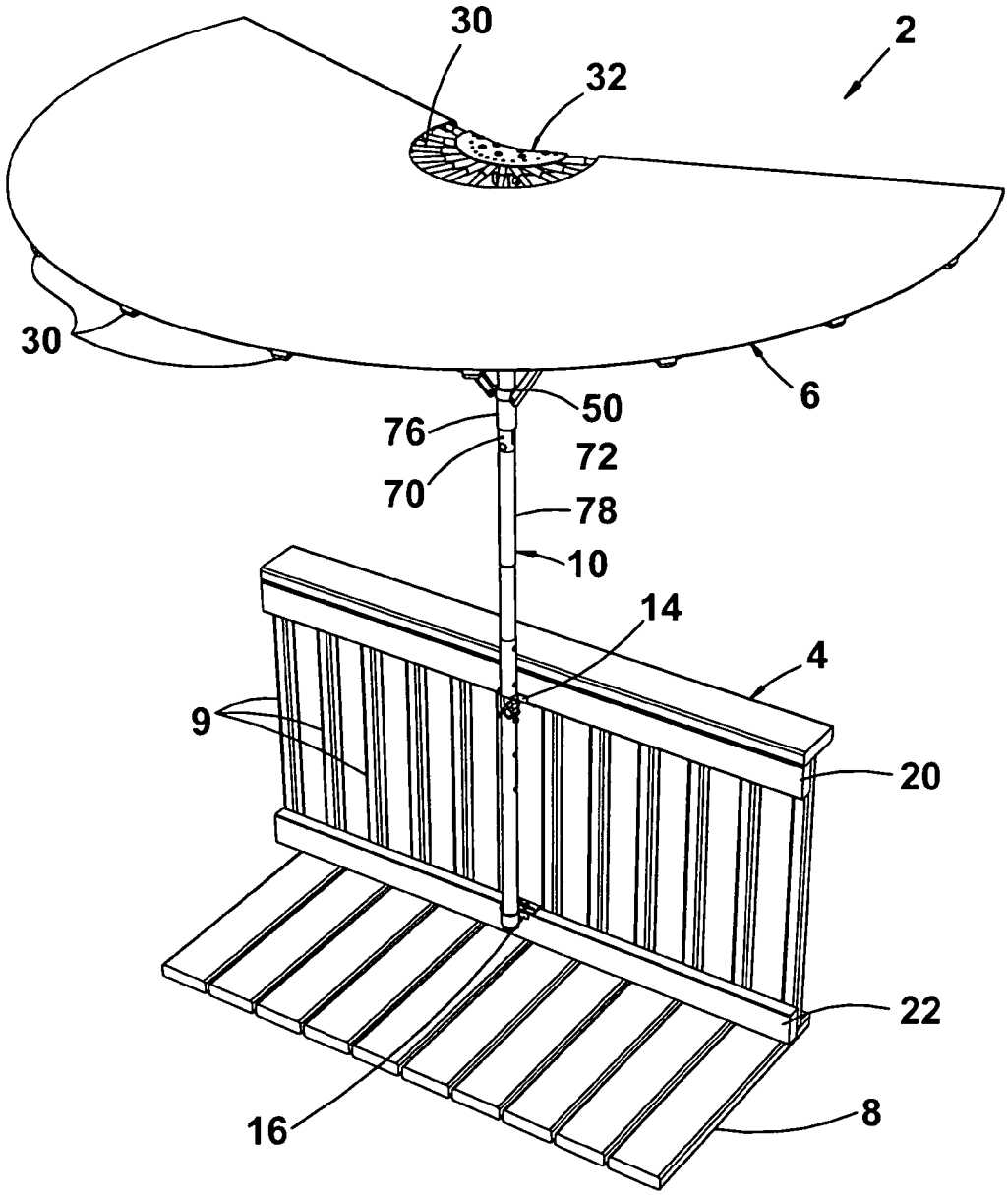
FIG. 1 is a perspective view of a railing mounted shade assembly with the shade or cover piece folded open.
Figure 2:
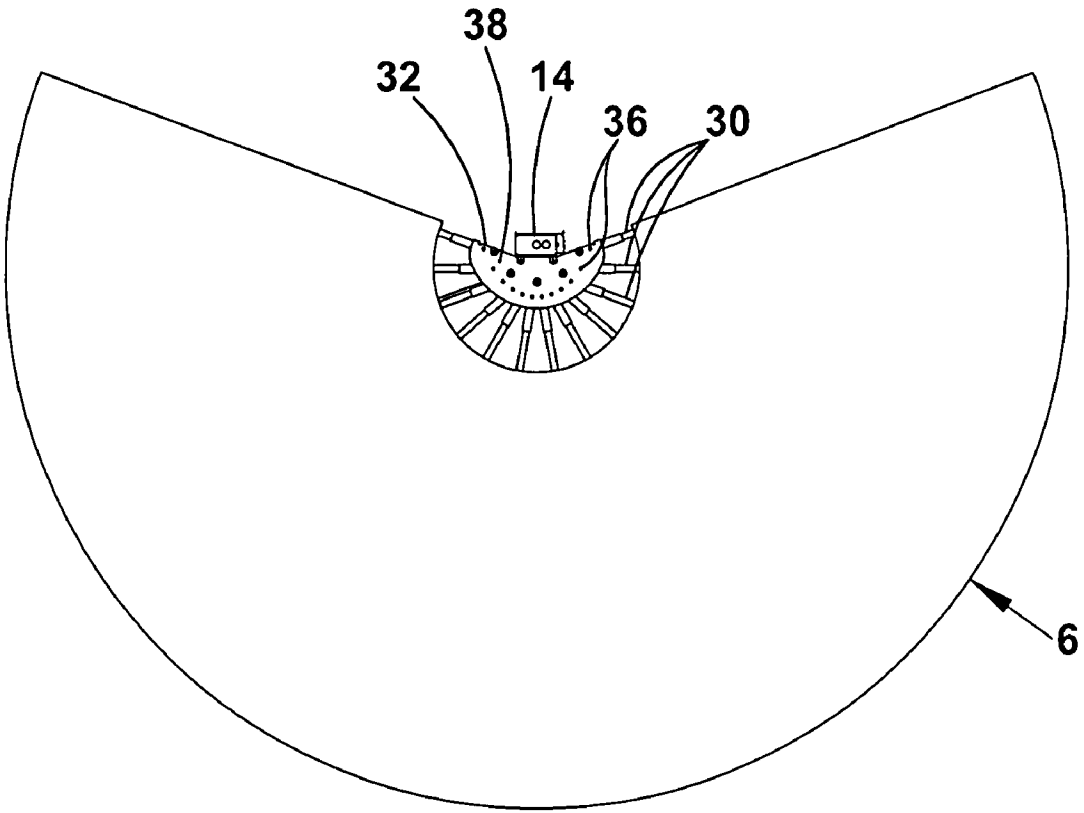
FIG. 2 is a top view of a railing mounted shade assembly with the shade folded open.
Figure 3:
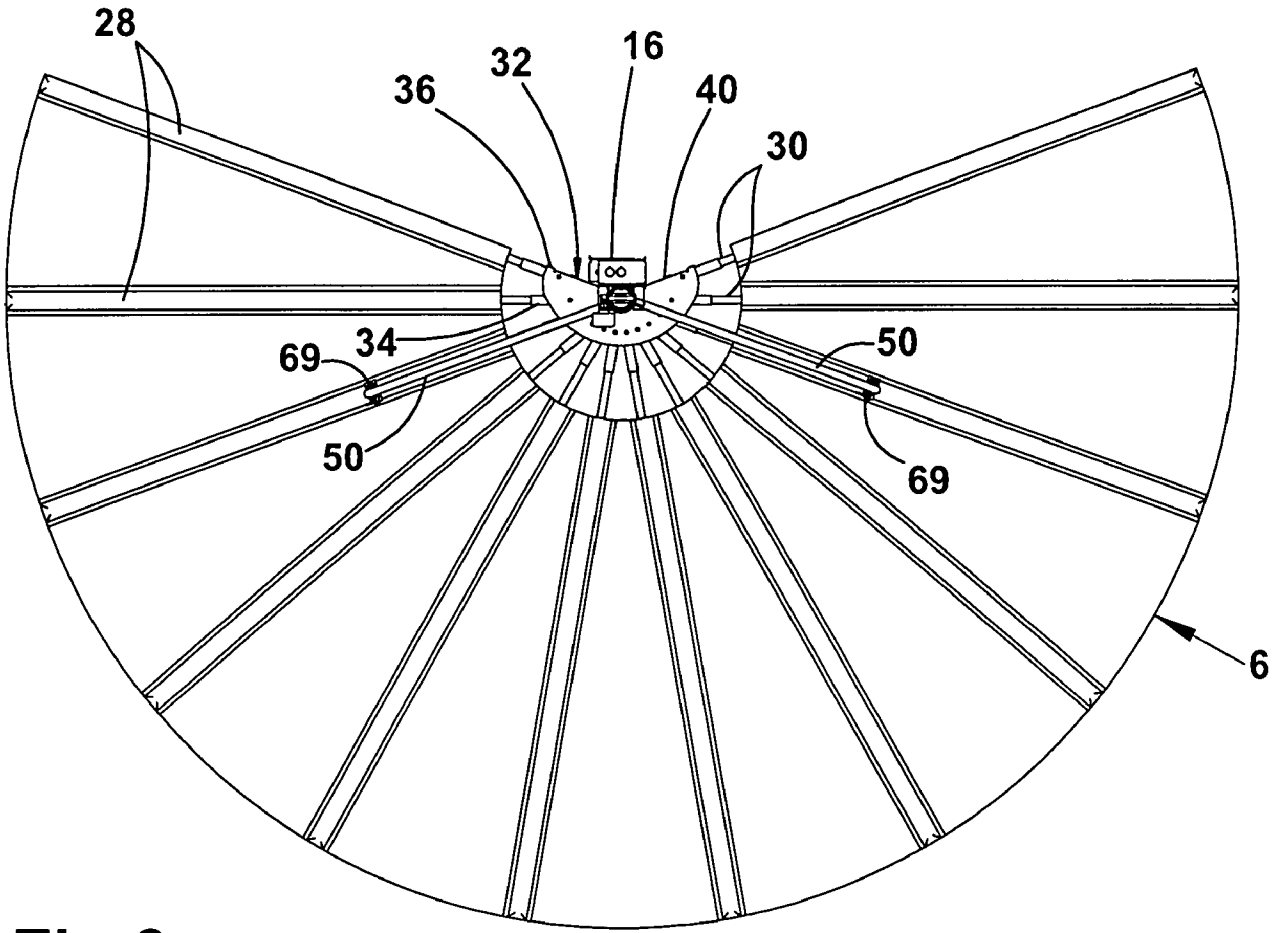
FIG. 3 is a bottom view of a railing mounted shade assembly with the shade folded open.
Figure 4:
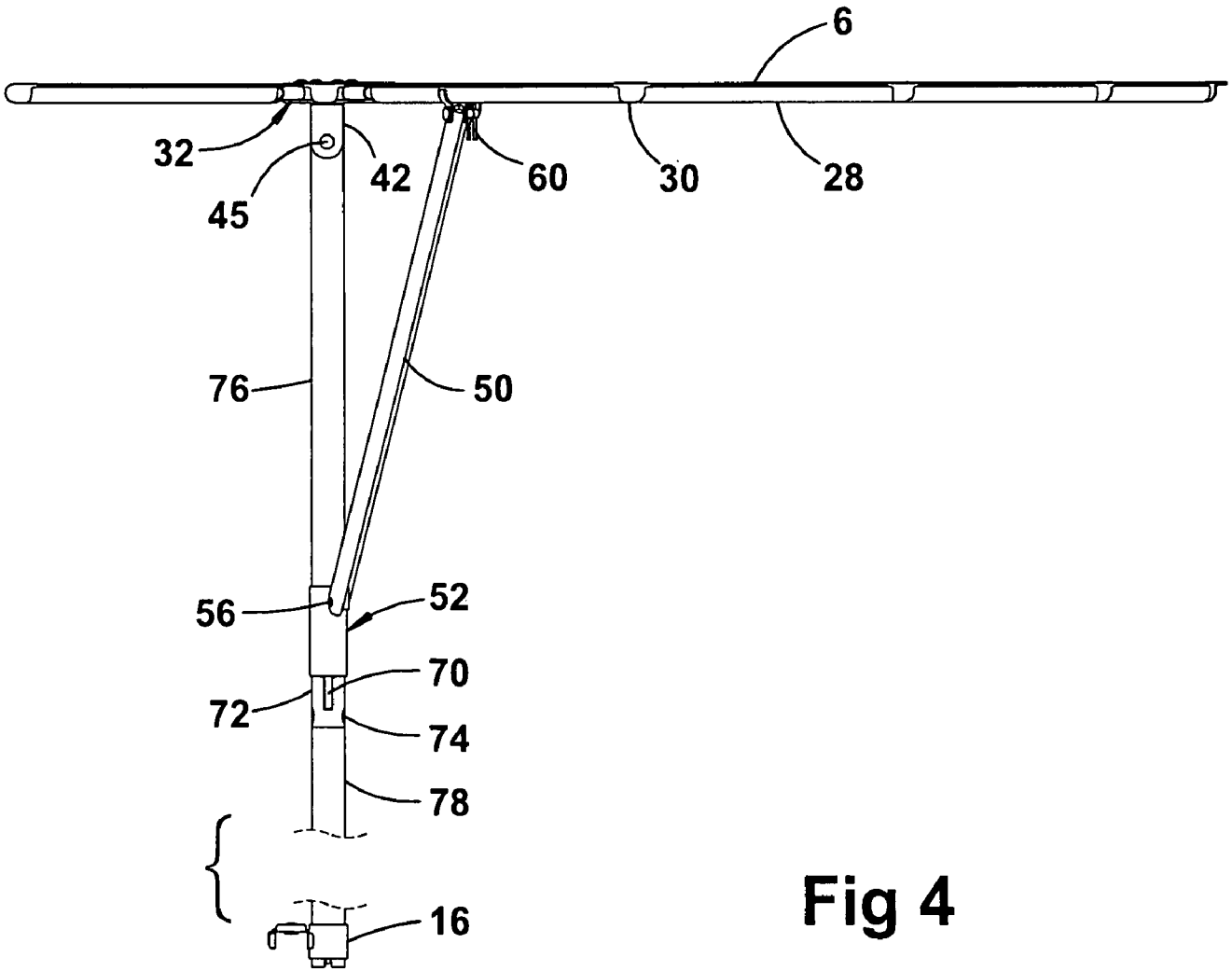
FIG. 4 is a front view of a railing mounted shade assembly with the shade folded open and with the support pole shown foreshortened.
Figures 5, 6:
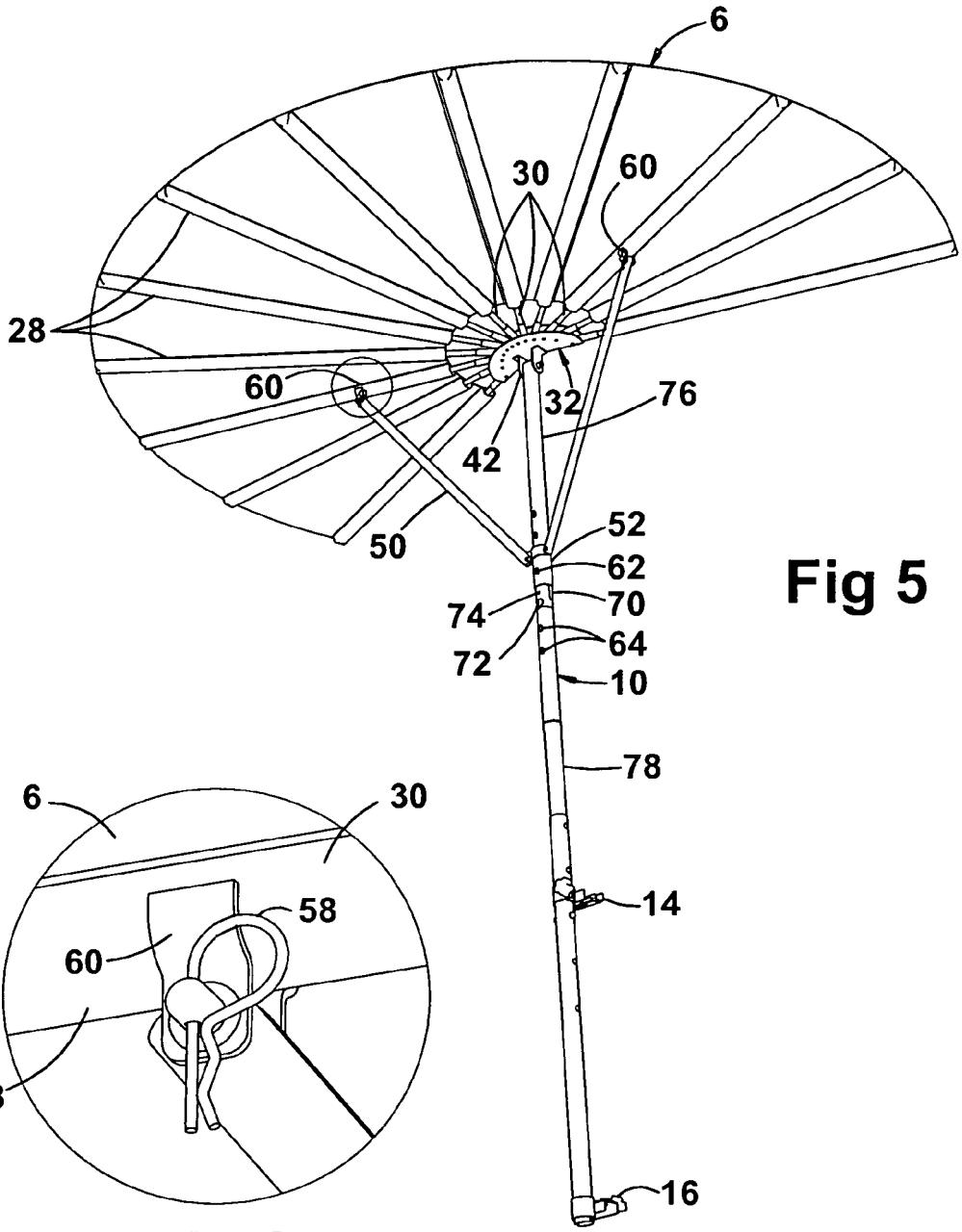
FIG. 5 is a perspective view of a railing mounted shade assembly from the bottom with the shade folded open, wherein the matter encircled in broken line is shown in enlarged scale at FIG. 6.
FIG. 6 is an enlarged view of the encircled portion of FIG. 5 depicting the mounting of a brace arm to a shade cover piece stay.
Figure 7:
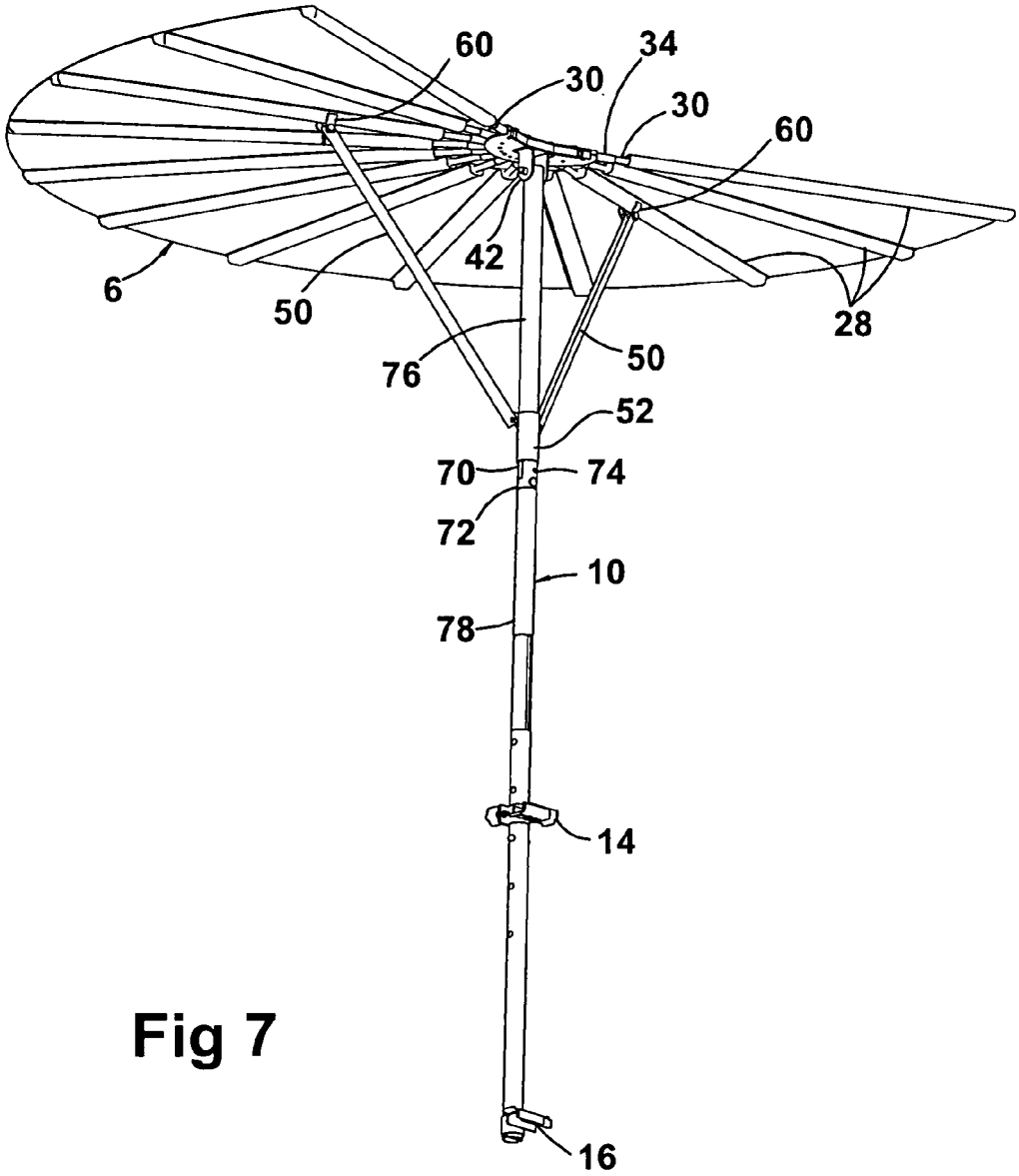
FIG. 7 is a perspective view of a railing mounted shade assembly from the bottom with the shade folded open and rotated approximately 180° from FIG. 5.

Referring to FIGS. 1-8, several perspective and plan views are shown to a sun shade assembly 2 of the invention. The shade assembly 2 is constructed and adapted to mount to a railing 4 such as found on patios, decks, balconies, gazeboes or similar outdoor structures (shown in dashed line) that are exposed to the sun and elements. A cover or shade piece 6 deploys to provide shade at the deck or balcony 8. A support pole piece 10 rigidly supports the shade or cover piece 6 to the railing 4. The support pole 10 when secured to a desired portion of the railing system 8 can be adjusted along multiple axes to advantageously position the shade cover piece 6 to intervene between the sun and appropriately shade the deck, patio or balcony space.

Figure 12:
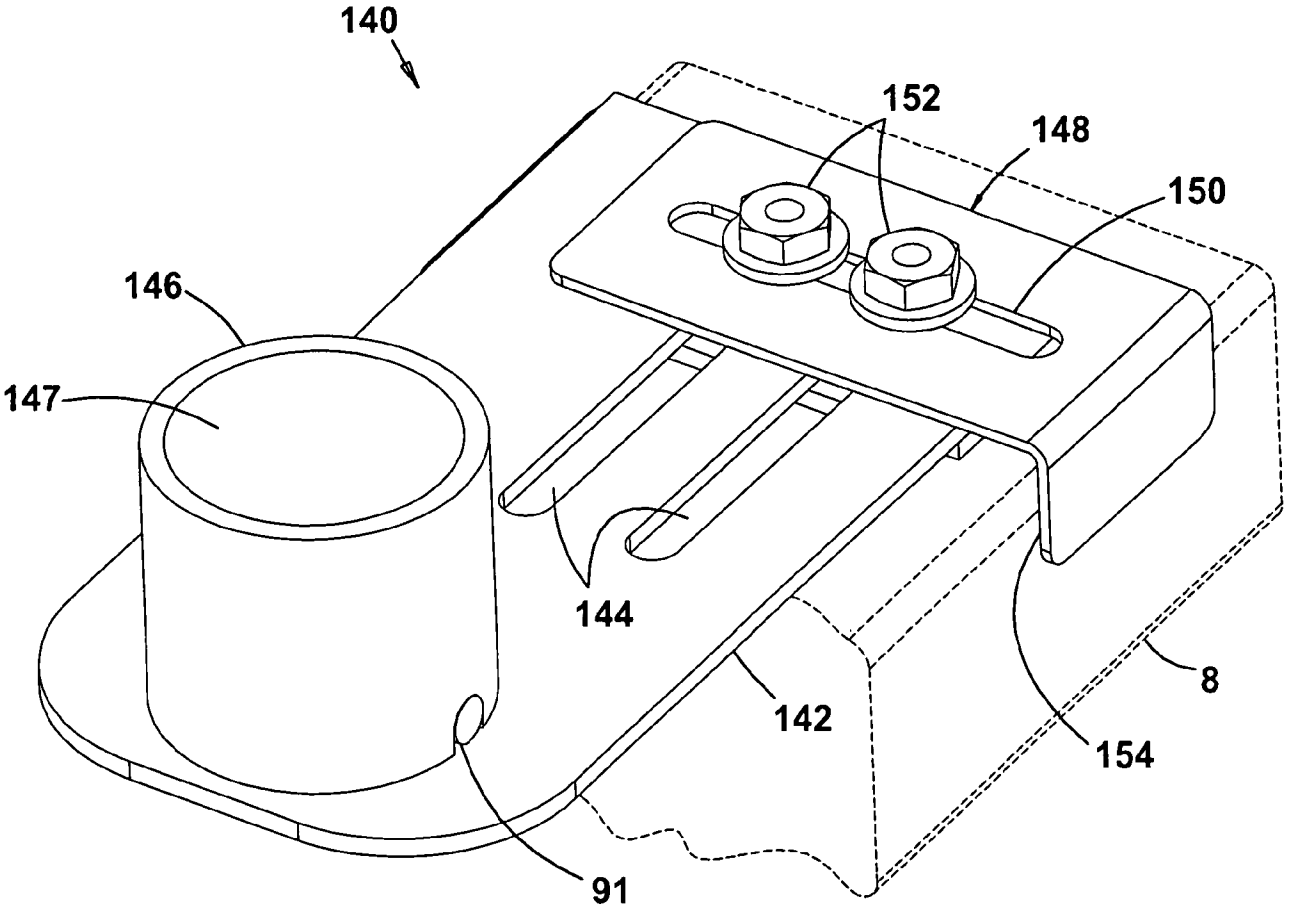
FIG. 12 is a perspective view of a coupler having a channel piece with an adjustable depending arm that mounts between deck boards and an arm that adjusts to vary the offset of a support pole retention collar from an adjoining rail system.
Figure 13:
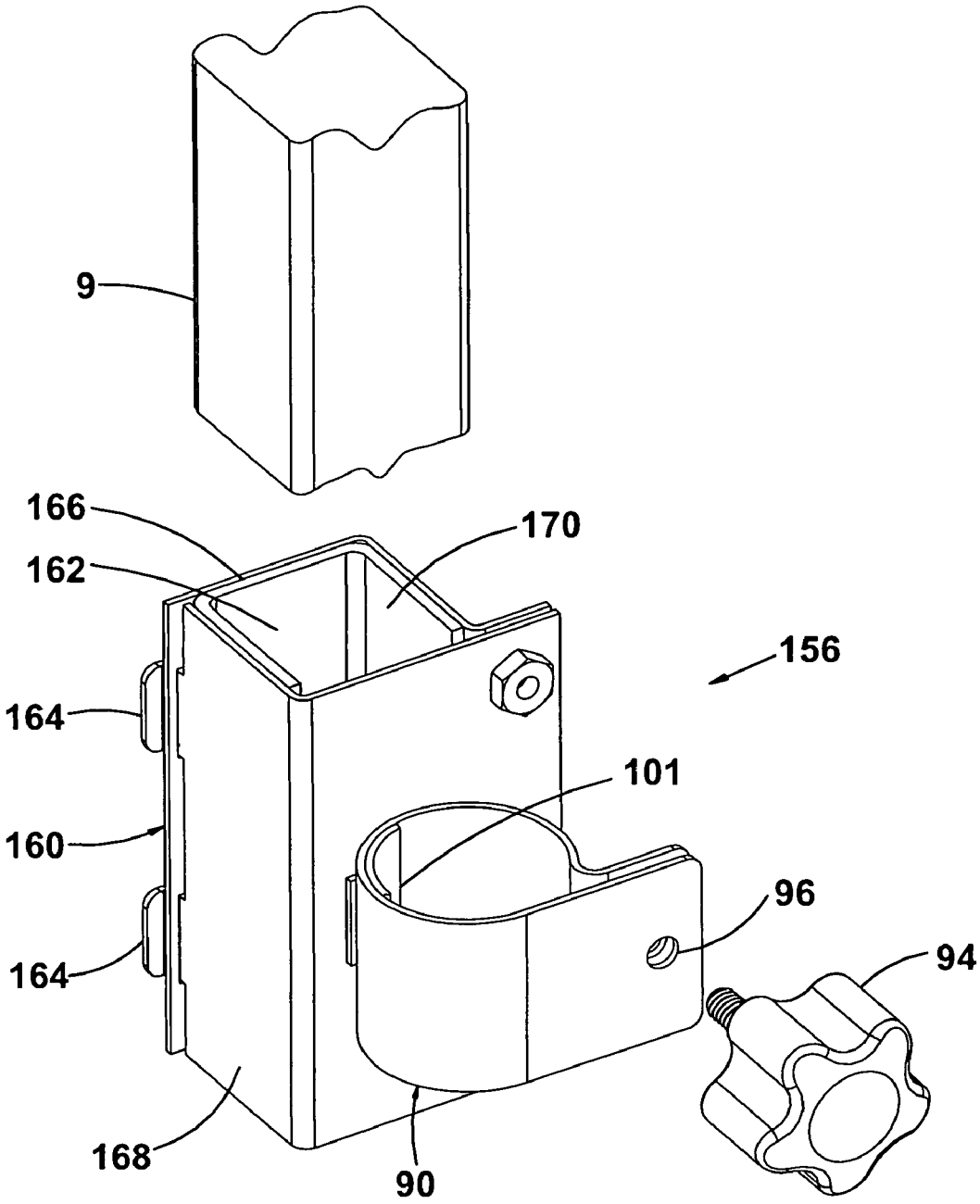
FIG. 13 is a perspective view of a coupler having an adjustable, split clamp piece that mounts to a railing baluster and a second adjustable, split coupler piece that that grips a support pole and secures the assembly to a railing system.

The assembly 2 is fastened to the railing system 4 with one or more rail fasteners 14 and 16 that attach to upper and lower rails 20 of the railing 4. Floor and baluster fastener pieces 140 and 156 are shown at FIGS. 12 and 13 that can be used as needed with the assembly 2. The clamp fasteners 14, 16, 140 and 150 are constructed to interlock with the rails 20, floor boards 8 and/or balusters 9 and can exhibit a variety of shapes and arrangements. FIGS. 9 through 13 depict in greater detail several alternative rail, deck board and baluster fasteners 79, 100 and 120, 140 and 156.

The clamp fasteners 14, 16, 79, 100, and 120, 140 and 156 can be selectively mounted anywhere along the railing system 4 or floor 8. The fasteners 14, 16, 79, 100, 120 and 156 are constructed with channel pieces having surfaces shaped or lined to conform to and grip associated rail or baluster pieces of the railing system 4. In normal practice as shown at FIG. 1, one fastener 14 is secured to an upper rail part 20 and a fastener 16 is secured to a lower rail part 22.

The fasteners 14 and 16 are normally secured to the railing system 4 to position the support pole 10 plumb to the floor 8. The fasteners 14 and 16 can also be positioned or laterally offset from each other to align the support pole 10 at a transverse angle to the floor 8, for example, to tip the support pole 10 into a prevailing wind. The upper fastener 14 rigidly grips the support pole 10 and secures associated channel pieces of the fasteners 14 and 16 to the rail pieces 20 and 22 to prevent the support pole 10 from lifting away from the railing system 4 or floor 8. Where the railing system 4 does not include a lower rail part 22, the clamp fastener 14 can be used alone or the floor fastener 140 shown at FIG. 12 can be aligned with the bottom of the pole 10.

With attention to FIGS. 2-7, several views are shown to the shade cover piece 6 and the cooperation between the shade cover piece 6 and support pole 10. The shade cover piece 6 preferably comprises a resilient material able to withstand exposure to the environment, particularly wind and UV radiation. Fabric materials are presently preferred which can be cut and sewn to a preferred shape. A variety of other resilient natural or synthetic materials may also be used alone or in combination. The material can be dyed to a uniform color, can exhibit a variegated appearance or can be printed (e.g. silk-screened) with a desired design.

Multiple seams, pleats or layers can be provided at the shade cover piece 6. The shade cover piece 6 can also comprise strips or bands of material secured together with other strips or bands. The geometric configuration of the shade cover piece 6 can be varied as desired. A presently preferred partial circular shape cooperates with a one-sided railing mounting, although a full circular shape can be used to equal advantage. Shade cover pieces 6 of other non-symmetric and/or aerodynamic shapes can also be constructed.

Figure 8:
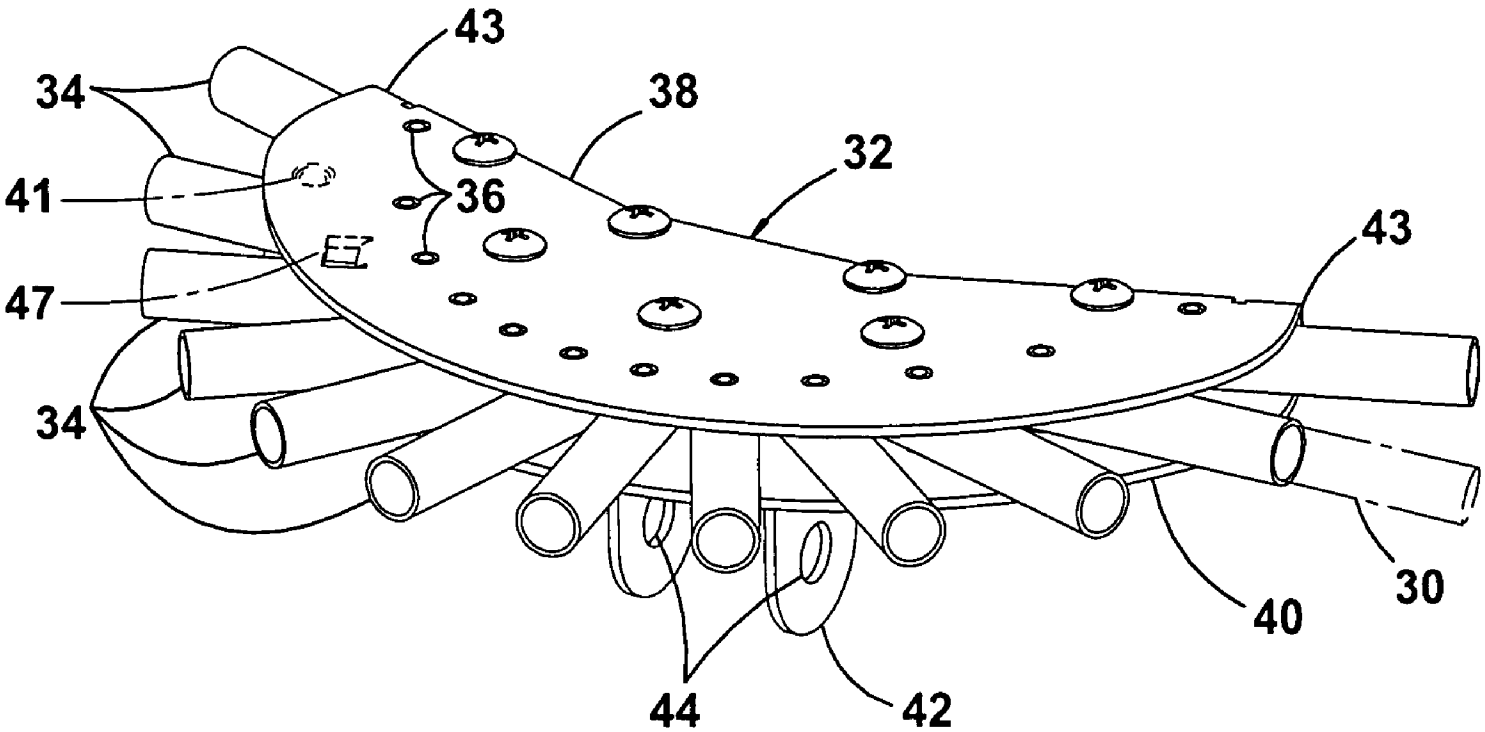
FIG. 8 is a perspective view of a hub piece that supports a number of radially directed cover piece support stays and wherein a portion of an exemplary stay is shown foreshortened along with dimples and tangs at the hub for controlling the horizontal rotation of radially directed stub couplers that support the stays.

The shade cover 6 is supported, fastened and/or stretched between several struts or stays 30 that radiate from a hub 32, see FIG. 8. The hub 32 provides several stub couplers 34 that are fastened to pivot pieces 36 mounted between upper and lower support plates 38 and 40. Each coupler 34 supports a stay piece 30 and each stay 30 is supported in a radially directed pocket 28 sewn into the underside of the shade cover piece 6.

The stub couplers 34 are captured to the hub 32 to deploy horizontally relative to the center-mounted support pole 10 between collapsed and deployed conditions. The stub couplers 34 and stays 30 pivot between the plates 38 and 40 about the pivot pieces 36 to vary the tension of the cover 6 as desired between a collapsed or relaxed condition and a taught condition. In a collapsed condition, the stub couplers 32 and stays 30 rotate to generally lie side by side and parallel to each other. In a deployed condition, the stub couplers 34 and stays 30 rotate away from each other to individual stop positions defined by the sewn pockets 28.

The stop positions can be defined or maintained with mating dimples/detents 41 (an example of which is shown in dashed line) provided at one or both hub plates 38 and 40 that mate with a recess at one or more of the stub couplers 32. Tangs 43 project from peripheral edges of the hub plates 38 and 40 and limit the maximum rotation of the stays 30 and stub couplers 34. Exemplary tangs 47 (shown in dashed line) can also be used in lieu of or in combination with the dimples/detents 41 to limit, control the reciprocating rotation (e.g. via tension) and/or fix rotation of the stub couplers 34 and stays 30. Draw cords or other linkages may also be adapted to control the reciprocating opening and closing of the stays 30 and prevent uncontrolled collapse.

A bracket 42 depends from the lower hub plate 40 and includes apertures 44 through which a pivot fastener 45 secures the hub 32 to the upper end of the support pole 10. The shade cover 6 can independently pivot or tip at the bracket 42 to vary the angle between the cover 6 and pole 10. The shade cover 6 can be made to tip as desired but a nominal range of motion of 50° to 90° relative to the support pole 10 is believed adequate to provide desired shade and accommodate typical winds.

The tipping action is controlled with a pair of arms 50 that extend from a sleeve coupler 52 concentrically mounted to slide up and down the support pole 10. A lower, inner end of each arm 50 is mounted to a pivot fastener 56 at the sleeve coupler 52 and an upper, outer end of each arm 50 is secured with a hairpin clip 58 to pivot plates 60 that depend from a pair of stays 30, see FIG. 6.

As the sleeve coupler 52 is raised and lowered along the support pole 10, the arms 50 control the orientation of the hub 32 and shade cover piece 6 relative to the support pole 10. A desired angle of the shade cover piece 6 can be fixed by manipulating a suitable fastener (e.g. spring pin) through an aperture or detent 62 at the sleeve coupler 50 and a mating aperture or detent 64 at the support pole 10. Although presently preferred adjustment assemblies are shown to control the relative angle between the hub 32, stays 30, and shade cover piece 6 to the support pole 10, a variety of other adjustable fastenings can be adapted to control the radial displacement of the shade cover piece 6 and angular orientation of the shade cover piece 6 to the support pole 10.

In the latter regard, the support pole 10 also provides a pair of hinge ends 70 and 72 that align with each other and pivot about a pivot pin 74 to vary the angle of upper and lower pole sections 76 and 78. Collectively, the hub bracket 42, arms 50, sleeve coupler 52 and hinged pole sections 76 and 78 control the angular alignment of the shade cover piece 6 relative to the support pole 10 and deck surface 8.

Although one type of hub assembly 32 and its associated stays 30, stub couplers 34, slide coupler 52 and arms 50 has been described, it is to be appreciated other pole-mounted shade assemblies can be adapted for use with the rail and deck fasteners 14, 16, 79, 100, 120, 140 and 156 of the invention described below. For example, common umbrella type shades that vertically expand and contract in response to a crank arm operated draw rope can be coupled to the deck fasteners 14-16 and 18. Such shades typically expand to a full circular shape although can be constructed to exhibit non-circular shapes when view from the top. Attendant pole adjustment accessories can also be varied or combined in different combinations.

Figure 9:
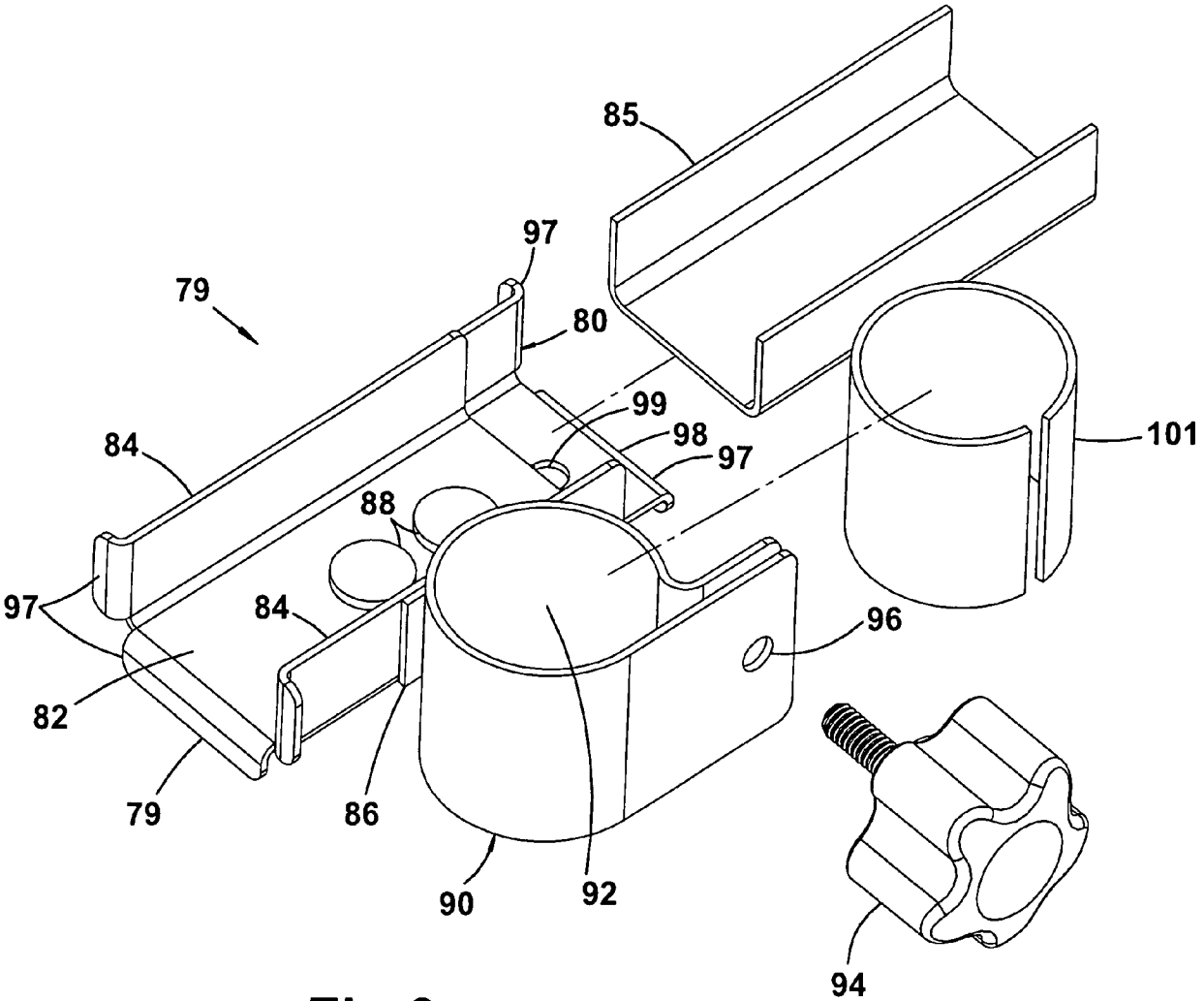
FIG. 9 is a perspective view of a railing system coupler having a width adjustable channel piece that mounts to a rail piece and includes a split, clamping collar piece that grips a support pole piece.
Figure 10:
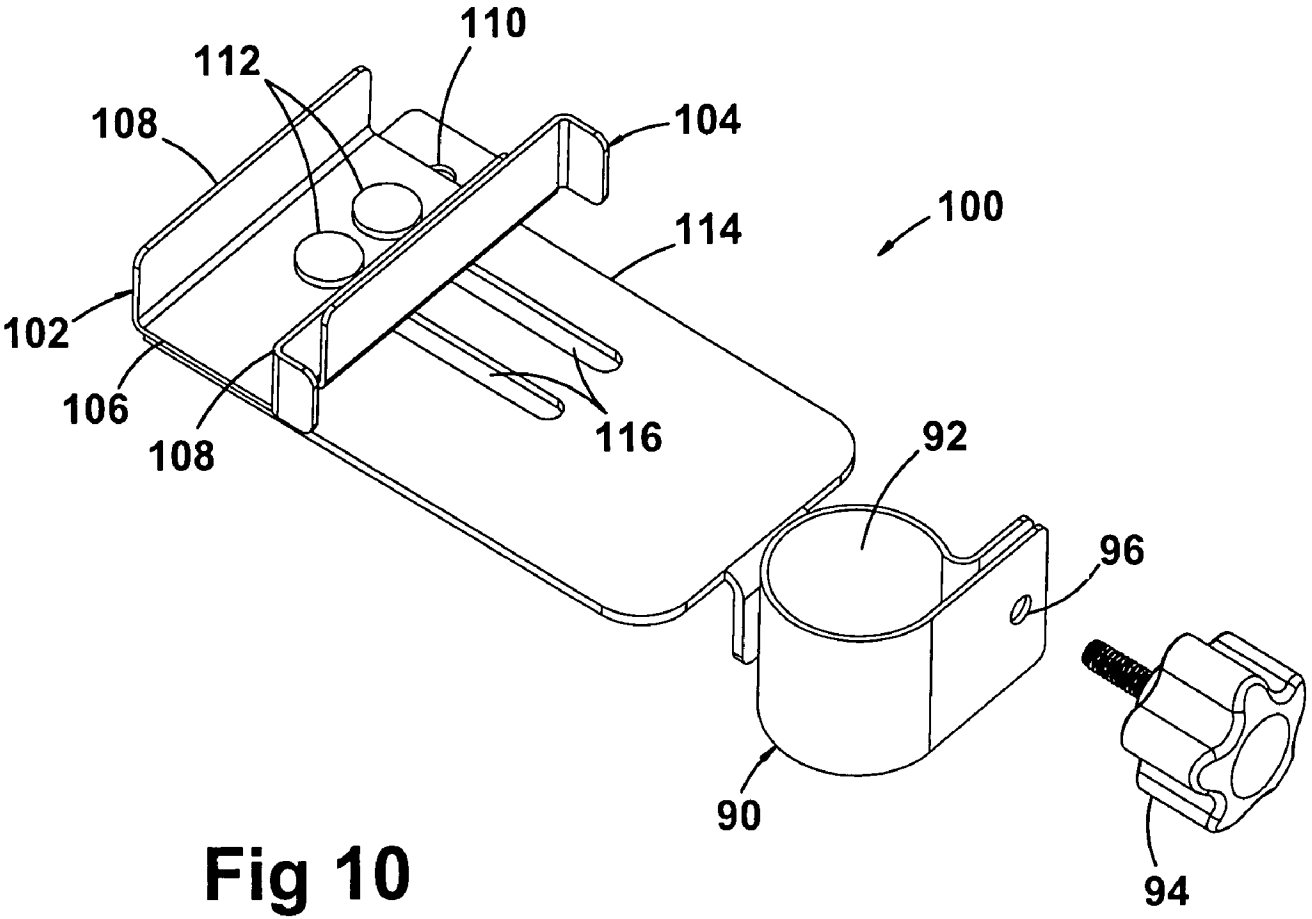
FIG. 10 is a perspective view of a railing system coupler that adjusts to the spacing between balusters and includes a fastener arm that extends and retracts to vary the offset of a split support pole clamping collar piece from the railing system.
Figure 11:
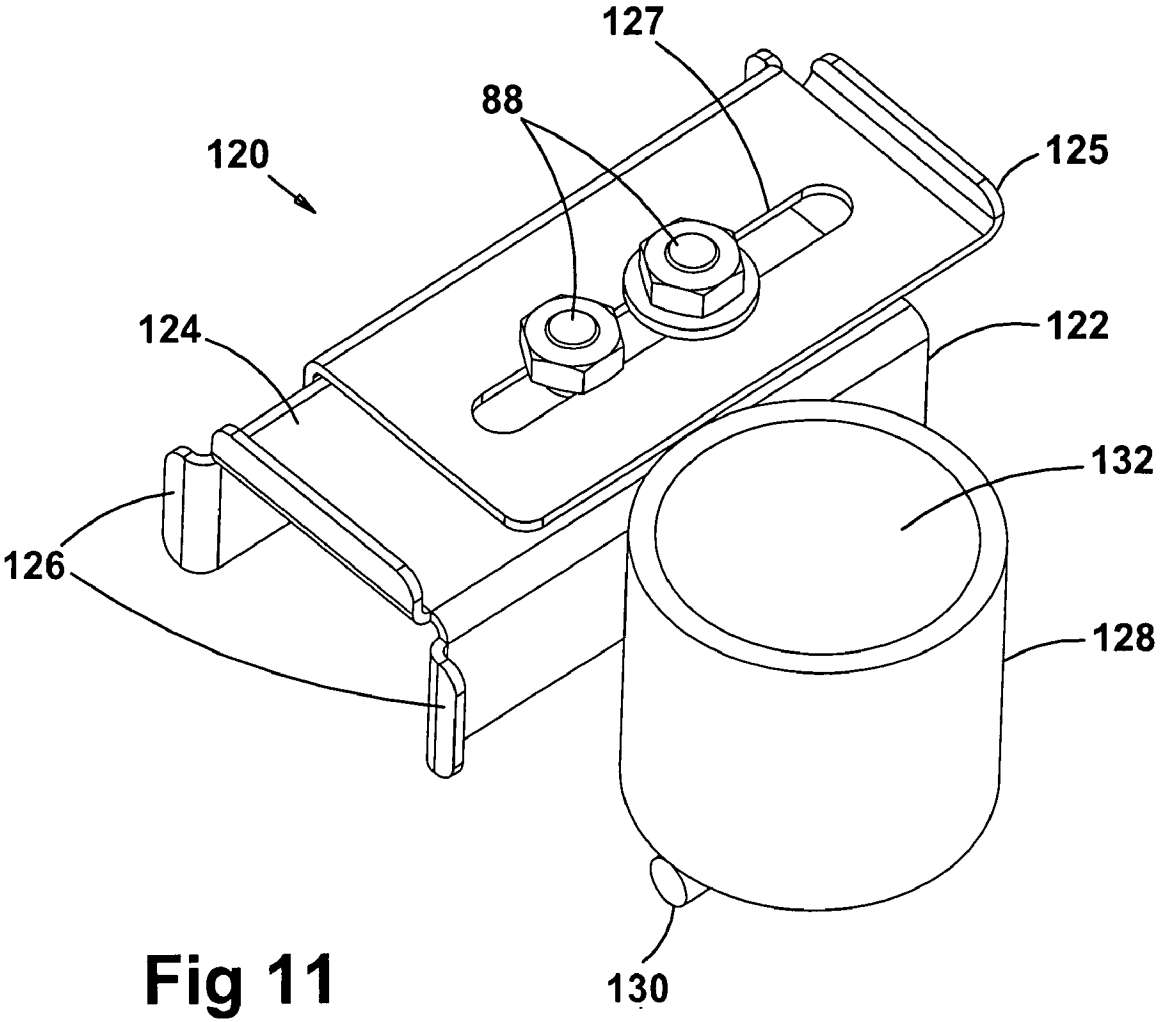
FIG. 11 is a perspective view of a base rail coupler having a channel piece that grips a rail piece and adjusts to the spacing between balusters and a collar piece that restrains the end of a shade pole piece.

With attention to FIGS. 9 through 11 detailed, enlarged perspective views are shown to upper and lower rail clamp fasteners 14 and 16 of the types shown in FIGS. 1 through 7. FIGS. 12 and 13 depict details to floor deck board and baluster clamp fasteners 140 and 156.

Referring to FIG. 9, one construction of an upper rail clamp fastener 79 constructed to mount to a typical 2×4 or 2×6 rail piece 20 is shown. The fastener 79 provides a channel piece 80 having a base wall 82 and adjoining upright side walls 84. The length of the channel piece 80 is sized to accommodate the spacing between balusters at the railing system 4. The side walls 84 are spaced apart the thickness of the rail piece 20, for example, approximately 1½ inch or the nominal thickness of the material used to construct the rail piece 20. The channel piece 80 is positioned to the underside of the rail piece 20 and between adjoining balusters 9 as the support pole 10 is secured to the upper rail fastener 79.

A resilient or conformal liner 85 can be supported in the channel space between the walls side 84. The liner 85 can be formed of a variety of rigid, resilient or other non-marring materials that grip or conform to the railing piece 20 (e.g. rubber, nylon, polyethylene etc.). The liner 85 prevents marring if the support pole 10 attempts to rotate relative to the railing system 4 in winds etc.

An L-shaped bracket arm 86 is secured to the base wall 82 with rivets 88, threaded fasteners (e.g. bolt/nut) or other suitable fasteners or welds. Secured to the bracket arm 86 is a split band or collar coupler 90 having a bore 92. The bore 92 is vertically aligned to support the support pole 10 when inserted into the bore 92. A threaded hand fastener 94 mates with a nut secured to one band end opposite apertures 96. A split, tubular liner or bushing piece 101 can also be supported to the support pole 10 in the bore 92 to facilitate gripping.

Prior to tightening the hand fastener 94, the channel piece 80 and liner 85 is/are elevated into secure alignment with the rail piece 20 and is held fast once the band coupler 90 is tightened. Upon tightening the hand fastener 94, the band ends are drawn together to compress the band coupler 90 and bushing 101 tight around the support pole 10.

The fastener 79 can be made to be adjustable relative to the space between balusters 9. In this instance, an extension or telescoping channel piece 98 is fastened to the channel piece 80 at a slot 99 through which the fasteners 88 extend. Upon telescoping the channel pieces 80 and 98 apart such that the flanged ends 97 contact adjoining balusters 9 and fixing the fasteners 88, the combined channel pieces 80 and 98 are securely held to the rail piece 20 between adjoining balusters 9.

FIG. 10 depicts an alternative upper rail fastener 100. The fastener 100 provides a channel piece 102 that overlaps an extension plate 104. The channel piece can include a liner 85. A base wall 106 and upright side walls 108 define a channel space of suitable width relative to the rail piece 20 (e.g. approximately 1½ inch). The extension plate 104 includes a slot 110 that cooperates with fasteners 112 to adjust the lateral extension or retraction of the plate 104 and width of the combined channel piece 102 and extension plate 104. The extension plate 104 permits adjustment of the upper rail fastener 100 to accommodate the spacing between adjoining balusters 9 at the railing system 4. Once a proper positioning is obtained, the fasteners 112 are drawn tight to fix the channel piece 102 relative to the extension plate 104 and an offset bracket plate 114.

The offset bracket plate 114 includes slots 116 that cooperate with the fasteners 112 to adjust the relative displacement of the band coupler 90 secured to the bracket plate 114. The offset of the band coupler 90 from the rail piece 20 can be adjusted to avoid a rail cap or other railing parts. As with the fastener 79, the channel piece 102 is elevated into secure alignment with the rail piece 20 where it is held fast after tightening the hand fastener 94. Liners 85 and 101 can be supported to the fastener 100.

FIG. 11 depicts a base rail clamp fastener 120 having a channel piece 122 with a base wall 124 and depending side walls 126 suitably spaced apart to mount over a lower rail piece 22. An adjustable, telescoping extension plate 125 is mounted to telescope from the base wall 124 via a slot 127 and fasteners 88. The channel piece 122 and extension plate 125 can be adjusted to fit the spacing between adjacent balusters 9.

A cylindrical collar 128 is secured to the channel piece 122 and includes an end stop 130. A bore 132 is sized to accept the bottom end of the support pole 10 which is isolated from contact and absorption of moisture from the deck floor 8 by the end stop 130. Upon positioning the rail clamp 120 to a lower rail piece 22, inserting the support pole 10 through the band coupler 90 of an upper rail fastener 14, 79 or 100 and into the bore 132 and drawing the upper clamp fastener 14, 79 or 100 to the upper rail piece 20, the hand fastener 94 is tightened and the relative positions of the support pole 10 and upper and lower clamp fasteners 14, 79 or 100 and 120 are fixed relative to the railing system 4. The support pole 10 is particularly held fast against rotation by the upper and lower channel pieces 80 and 102 and 122 and against lifting by the band coupler 90.

For railing systems that don't provide a lower railing piece, FIG. 12 depicts a floor clamp fastener 140 and particularly an adjustable floor clamp fastener 140 having a base plate 142 with slots 144 and an end collar or socket 146 secured to the base plate 142. A flange arm 148 having a slot 150 mounts to the base plate 142 with fasteners 152 such that the extension of the collar 146 can be adjusted relative to a depending flange leg 154 of the arm 148. The flange leg 154 mounts between floor boards (shown in dashed line) at the deck floor 8. Upon positioning the floor fastener 140 to the deck floor 8, inserting the support pole 10 into the bore 147 of the socket 146 and drawing the upper clamp fastener 14, 79 or 100 to the upper rail piece 20, the hand fastener 94 is tightened and the relative positions of the support pole 10, upper clamp fastener 14, 79 or 100 and floor fastener 140 are fixed relative to the railing system 4.

Depending upon the railing system 4 and deck floor 8, at times it may be necessary to fasten the support pole 10 to a baluster 9 of the railing system 4. An exemplary fastener 156 of this type is depicted in detail at FIG. 13. The fastener 156 provides a baluster collar portion 160 and a pole band collar 90. The baluster collar portion 160 can be constructed in one or two pieces that facilitate opening to receive a baluster 9 within a vertical bore 162.

A one piece collar 160 can be made to permit bending to open longitudinal, split peripheral edges of the collar 160. A two piece collar 160 can include hinge pieces 164 that interlock along one edge of mating collar pieces 166 and 168 to permit the collar pieces 166 and 168 to pivot and expand and contract to receive and compress around a baluster 9 in the bore 162 until fastened together about the baluster 9. Split ends at each collar portion 90 and 160 are drawn together with suitable hand fasteners 94 (only one of which is shown).

A resilient liner or split bushing 170 of appropriate size and shape can be mounted over the baluster 9 and into the bore space 162 prior to fastening the collar ends/pieces 166 and 168 together. The collar 160 can be compressed tight to the baluster 9 or merely held to prevent detachment of the collar 160.

A band coupler 90 otherwise is secured to the collar piece 160 and the support pole 10 in a similar fashion as discussed above. The liners 170 and 101 should be fabricated from materials such as used to construct the rail liners 85 and can be fitted to one or both of the collar pieces 160 and 90 to facilitate attachment.

While the invention has been described with respect to a number of preferred constructions, considered improvements and/or alternatives thereto, still other shade cover, pole or rail system fastener constructions may be suggested to those skilled in the art. It is to be appreciated that selected ones of the foregoing features can also be used singularly or can be arranged in different combinations to provide a variety of railing mounted shade systems. The foregoing description should therefore be construed to include all those embodiments within the spirit and scope of the following claims.

What is claimed is:

1. A shade assembly adapted to attach to a railing system including a plurality of horizontal rail members coupled to a plurality of baluster members vertically projecting relative to a floor comprising:

a) a shade cover having a flexible member and means for expanding and contracting the flexible member to vary the tension of the flexible member between collapsed and deployed conditions;

b) a pole adapted to support said shade cover and including means for varying the relative angular displacement of the shade cover to the pole; and c) first and second fasteners each having a horizontal channel space adapted to respectively contain a first and a second rail member of a railing system within the horizontal channel space and further including respective first and second collars adapted to contain said pole to said first and second fasteners and fix the separation of the first and second fasteners to the first and second rail members, wherein at least one of said first and second fasteners includes first and second channel pieces mounted to reciprocally telescope relative to each other to extend and abut adjoining balusters of a railing system, wherein a fastener fixes the relative extension of said first and second channel pieces, whereby upon mounting the first and second fasteners to the first and second rail members and the pole to the first and second fasteners, the pole and cover are contained to a railing system.

2. A shade assembly as set forth in claim 1 wherein said flexible member comprises a fabric.

3. A shade assembly as set forth in claim 1 wherein said flexible member is supported by a plurality of underlying stays that horizontally radiate from a hub mounted to said pole, wherein said hub includes at least one semi-circular plate, wherein each stay is mounted to said plate and secured to independently pivot coplanar to said first plate, wherein a bracket depends from said plate, and wherein a plurality of said stays are secured to said cover such upon radially pivoting said stays the cover expands and contracts.

4. A shade assembly as set forth in claim 1 wherein said hub is mounted to pivot about an axle fitted to said bracket and including means for fixing the relative angular alignment of the colanar hub, stays and fabric member to the pole once pivoted.

5. A shade assembly as set forth in claim 4 including a coupler mounted for reciprocating movement along said pole and having arms coupled to said stays to vary the angular alignment of said hub and flexible member to the pole.

6. A shade assembly as set forth in claim 1 wherein said pole comprises first and second sections interconnected to each other at a coupler adapted to pivot about an included axle to vary the axial alignment of the first and second sections relative to each other.

7. A shade assembly as set forth in claim 1 wherein said first collar includes a slit communicating with a bore and including means for drawing portions of said collar on opposite sides of said slit into compression with said pole.

8. A shade assembly as set forth in claim 1 including a member mounted to transversely and reciprocally extend and retract relative at least one of said first and second fasteners and supporting either said first or said second collar and including means for fixing the extension of said first or second collar to said first or second fastener and thereby the displacement of the pole away from a contained rail member.

9. A shade assembly as set forth in claim 1 wherein each of said first and second fasteners comprises said first and second channel pieces and fasteners for fixing the relative extension of the channel pieces between adjoining balusters, wherein the first collar is adapted to compressively fasten to said pole, wherein the second fastener contains a second rail member extending horizontal beneath said first rail member, and wherein the second collar supports a bottom end of the pole.

10. A shade assembly as set forth in claim 9 wherein each of said first sand second fasteners includes a member mounted to transversely and reciprocally extend and retract relative to the included first and second channel pieces, wherein the transversely extending members support said first and second collars and include means for fixing the extension of the first and second collars and thereby the displacement of the pole away from the contained rail members.

11. A shade assembly adapted to attach to a railing system including a plurality of horizontal rail members coupled to a plurality of baluster members vertically projecting relative to a floor comprising:

a) a shade cover having a fabric member supported by a plurality of underlying stays that radiate from a central hub, wherein said hub includes first and second plates, wherein each stay is mounted between said first and second plates and secured to independently pivot coplanar to said first and second plates, wherein a bracket depends from one of said first and second plates, and wherein a plurality of said stays are secured to said cover such that said cover expands and contracts as said stays pivot at the first and second plates;

b) a pole mounted to an axle fitted to said bracket to pivot about the axle and including means for fixing the relative angular alignment of the coplanar hub, stays and fabric member to the pole once pivoted c) a first fastener having a horizontal channel space adapted to contain a first rail member of a railing system within the channel space, wherein first and second channel pieces are mounted to laterally telescope relative to each other to extend and abut adjoining balusters of a railing system, wherein a fastener fixes the extension of said first and second channel pieces, and wherein a first collar projects from said first fastener and is adapted to contain and fasten said pole to said first fastener to fix said first fastener along said pole; and d) a second fastener having a horizontal channel space adapted to contain a second horizontal rail member extending beneath said first rail member within the channel space and including a second collar adapted to contain an end of said pole such that upon mounting said first and second channel pieces of said first fastener to the first rail, inserting the pole in said first and second collars and fastening the first collar to the pole, the pole and cover are contained to the railing system.

12. A shade assembly as set forth in claim 11 including a coupler mounted for reciprocating movement along said pole and having arms coupled to said stays to pivot said hub, stays and flexible member to vary the angular alignment of said cover relative to the pole.

13. A shade assembly as set forth in claim 12 wherein said first collar includes a slit communicating with a bore and including means for drawing portions of said collar on opposite sides of said slit into compression with said pole.

14. A shade assembly as set forth in claim 11 wherein said second fastener includes first and second channel pieces mounted to laterally telescope relative to each other to extend and abut adjoining balusters of a railing system, wherein a fastener fixes the extension of said first and second channel pieces, and wherein said second collar projects from the first and second channel pieces of said second fastener, wherein said second collar includes a stop to limit the separation of said pole from said first fastener and vertically fix said first fastener to the first rail member.

15. A shade assembly as set forth in claim 11 including a member mounted to transversely and reciprocally extend and retract relative at least one of said first and second fasteners and supporting either said first or said second collar and including means for fixing the displacement of said first or second collar and pole away from the first or second fastener and contained rail member.

16. A shade assembly as set forth in claim 11 wherein said first fastener includes a member mounted to transversely and reciprocally extend and retract relative the first and second channel pieces of the first fastener and support said first collar and including means for fixing the displacement of said first collar and pole away from the first fastener and a contained rail member.

17. A shade assembly as set forth in claim 16 wherein said second fastener includes first and second channel pieces that define the channel space and mount together to laterally telescope relative to each other to extend and abut adjoining balusters of a railing system, wherein a fastener fixes the extension of said first and second channel pieces, wherein said second fastener includes a member mounted to transversely and reciprocally extend and retract relative one of said first and second channel pieces and support said second collar and including means for fixing the displacement of said second collar and pole away from the second fastener and a contained rail member.

18. A shade assembly adapted to attach to a railing system including a plurality of horizontal rail members coupled to a plurality of baluster members vertically projecting relative to a floor comprising:

a) a shade cover having a fabric member contained to and supported by a plurality of underlying stays that radiate from a central hub, wherein said hub includes first and second semi-circular plates, wherein each stay is mounted between said first and second plates and secured to independently pivot coplanar to said first and second plates, wherein a bracket depends from one of said first and second plates, and wherein a plurality of said stays are secured to said cover such that said cover expands and contracts as said stays pivot coplanar to said plates;

b) a pole mounted to pivot about an axle fitted to said bracket and adapted to support the fabric member and including means for fixing the relative angular alignment of the coplanar hub, stays and fabric member to the pole once pivoted;

c) a first fastener defining a horizontal generally U-shaped channel space adapted to contain a first rail member of a railing system within the channel space, wherein first and second channel pieces are mounted to laterally telescope relative to each other to extend and abut adjoining balusters of a railing system, wherein a fastener fixes the extension of said first and second channel pieces, and wherein a first collar projects from said first fastener and is adapted to contain and fasten said pole to said first fastener to fix said first fastener along said pole; and d) a second fastener having a horizontal channel space adapted to contain a second horizontal rail member of a railing system extending beneath said first rail member and including a second collar having a stop to contain an end of said pole and whereby upon mounting said first and second pieces of said first and second rail members, inserting the pole in said first and second collars and fastening the first collar to the pole, the pole and cover are contained to the railing system.

* * * * *